US006889840B2

(12) United States Patent
Schein et al.

(10) Patent No.: US 6,889,840 B2
(45) Date of Patent: May 10, 2005

(54) SALE AND STORAGE PACKAGING FOR ZINC-AIR CELLS

(75) Inventors: Herbert Schein, Munningen (DE); Anja Krüger, Ellwangen (DE); Helmut Hewelt, Ellwangen (DE); Manfred Hägele, Abtsgmünd (DE); Manfred Bradler, Ellwangen (DE); Heinrich Stelzig, Rosenberg (DE)

(73) Assignee: Varta Microbattery GmbH (DE)

( * ) Notice: Subject to any disclaimer, the term of this patent is extended or adjusted under 35 U.S.C. 154(b) by 0 days.

(21) Appl. No.: 10/322,396

(22) Filed: Dec. 17, 2002

(65) Prior Publication Data

US 2003/0111384 A1 Jun. 19, 2003

(30) Foreign Application Priority Data

Dec. 19, 2001 (DE) ..... 201 20 503 U

(51) Int. Cl.[7] ..... B65D 85/88; B65H 1/00

(52) U.S. Cl. ..... 206/704; 206/462; 206/467; 221/122; 221/133

(58) Field of Search ..... 206/704, 461, 206/467, 469–470, 531–532, 538–539, 807, 462–463; 221/122, 133; 429/99–100

(56) References Cited

U.S. PATENT DOCUMENTS 2,233,602 A * 3/1941 Greeley ..... 229/229
2,971,638 A * 2/1961 Allison et al. ..... 206/532
4,015,708 A 4/1977 Kelm
4,270,659 A * 6/1981 Kuchenbecker ..... 206/538
4,953,700 A * 9/1990 DeDino ..... 206/704
5,203,455 A * 4/1993 Hewelt et al. ..... 206/704
6,039,185 A * 3/2000 Pedracine et al. ..... 206/704

FOREIGN PATENT DOCUMENTS

| | | |
|---|---|---|
| DE | 78 10 653 | 7/1978 |
| DE | 3417371 A1 | 11/1985 |
| DE | 36 30 926 A1 | 3/1988 |
| DE | 41 28 248 A1 | 3/1993 |
| WO | WO 01/87732 A1 | 11/2001 |

* cited by examiner

*Primary Examiner*—Bryon P. Gehman
(74) *Attorney, Agent, or Firm*—DLA Piper Rudnick Gray Cary US LLP

(57) ABSTRACT

A packaging for galvanic cells including a carrier; a rotatable insert arranged on the carrier, wherein the rotatable insert has blisters to accommodate a plurality of the galvanic cells and the carrier has an opening to withdraw one of the cells from the insert; and a cover, arranged such that the insert is arranged between the carrier and the cover, the carrier and the cover being sealed together such that the insert is free to rotate, wherein the cover has an opening to accommodate the insert, and the carrier has a securable tab that allows withdrawal of one of the cells from the insert.

17 Claims, 1 Drawing Sheet

SALE AND STORAGE PACKAGING FOR ZINC-AIR CELLS

RELATED APPLICATION

This application claims priority of German Patent Application No. 201 20 503.3, filed on Dec. 19, 2001.

FIELD OF THE INVENTION

This invention relates to packaging of the general type for galvanic cells, in particular, zinc-air cells.

BACKGROUND

The growing consumption of zinc-air button cells, in particular, cells for hearing aids, has elevated the importance of packaging of this mass-produced item to the rank of a major factor. Their packaging must be both economical and have an attractive appearance to promote buying interest.

Proceeding based on tablet packaging of the pharmaceutical industry, packaging for hermetically sealed button cells, rechargeable NiCd-systems, or $Ag_2O$—Zn and HgO—Zn primary systems that consists of, for example, pairs of interlocking plastic shells, have been introduced. One of those shells was subdivided into a circular array of compartments for accommodating cells and could be rotated with respect to the other shell such that those compartments could, one after the other, be brought into coincidence with a dispensing opening in the other shell and the cell involved withdrawn.

However, in the case of zinc-air cells, there arises the special problem that the air-inlet openings in their cathode cup must be sealed to prevent ingress of air and exclude moisture until such time as they are placed in service, i.e., that their packaging must also be such that cells may be stored in it.

A corresponding packaging element is represented by, e.g., the press-out packaging described in Germany Patent Application DE 3630926 A1. The cells contained therein are fully protected against ingress of ambient air between a tear-resistant, air-tight, transparent, plastic foil having bowl-shaped blisters and a sheet of aluminum foil that is bonded thereto.

U.S. Pat. No. 4,015,708 discloses a folding box for use as a packaging element for zinc-air cells that incorporates a cardboard carrier having circular recesses for accommodating button cells whose bases are cemented onto a foil on the reverse side of the carrier.

Another embodiment of a sales packaging for zinc-air cells is disclosed in German Patent Application DE 4128248 A1. That patent application depicts a sale and storage packaging for zinc-air cells having a carrier to which the bases of cells, which are provided with air-inlet openings, are cemented. A transparent plastic cover having bowl-shaped recesses that essentially conform the shape of the cells is attached to the carrier. Cells may be pressed through the carrier whenever needed. Another foil that extends into the vicinity of the carrier is attached to the carrier. Cells may be pressed through this foil, which is provided with an adhesive coating, at least at those locations where the bases of cells adhere to it, but which remains attached to the carrier after cells have been pressed through it and withdrawn.

It would therefore be advantageous to provide a packaging such that individual cells cannot be removed therefrom without leaving traces thereof, that the packaging is resealable, and that cells may be readily withdrawn therefrom.

SUMMARY OF THE INVENTION

This invention relates to a packaging for galvanic cells including a carrier, a rotatable insert arranged on the carrier, wherein the rotatable insert has blisters to accommodate a plurality of the galvanic cells and the carrier has an opening to withdrawn one of the cells from the insert, and a cover arranged such that the insert is arranged between the carrier and the cover, the carrier and the cover being sealed together such that the insert is free to rotate, wherein the cover has an opening to accommodate the insert, and the carrier has a securable tab that allows withdrawal of one of the cells from the insert.

BRIEF DESCRIPTION OF THE DRAWINGS

Aspects of the invention will be discussed in detail in the following, based on the Figures, which depict a sample embodiment of the invention.

DETAILED DESCRIPTION

Figure 3:
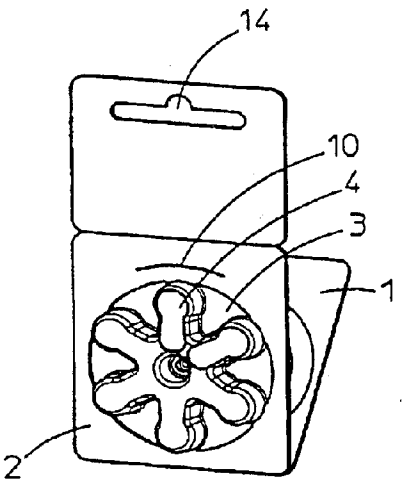
FIGS. 1–4 are perspective view depicting the layout and assembly procedures for a packaging according to the invention.
Figure 2:
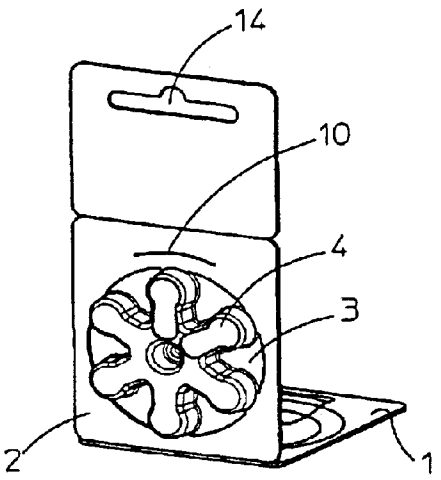

It will be appreciated that the following description is intended to refer to specific embodiments of the invention selected for illustration in the drawings and is not intended to define or limit the invention, other than in the appended claims.

The wording of the claims is herewith made an integral part of this description by way of expressed reference thereto. The terms "has/having" or "comprising", as used in this patent application, shall be interpreted as implying "has/having, among other features", and shall not be construed as referring to that particular feature/those particular features explicitly stated only.

The packaging according to the invention is particularly beneficailly designed to serve as either a sales packaging and/or a storage packaging. In general, it may be designed to accommodate numerous types of galvanic cells. However, it is preferably designed for accommodating zinc-air cells or button cells, for which several of its aforementioned special features are to be taken into account. These special features may be obtained in particularly beneficially manners using prospective embodiments of the invention.

The carrier and cover may be fabricated from flat sheet stock, where either plastics or cardboard are particularly beneficial choices of materials. Although the rotatable insert is preferably transparent such that cells will be visible and, for example, technical data, will be legible, it may also consist of an opaque material which will simplify its fabrication, or may consist of an opaque material for other reasons.

Figure 1:
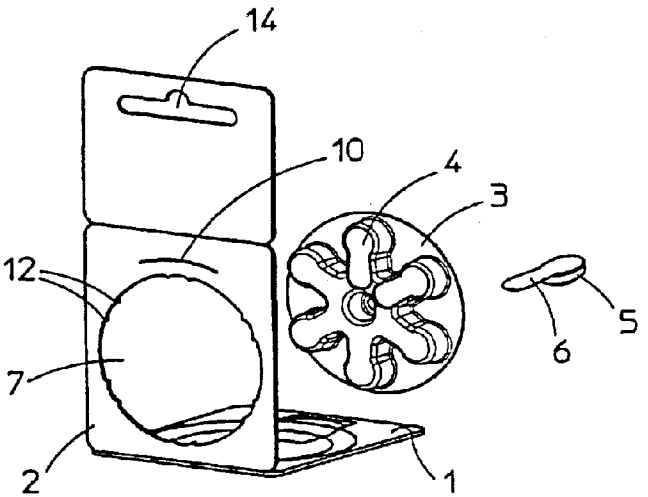
Figure 4:
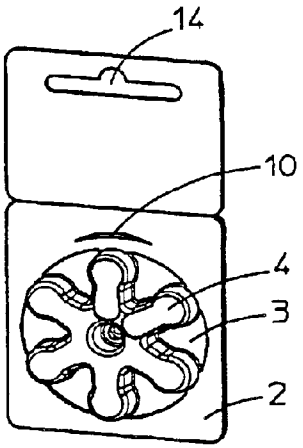

The packaging depicted in FIG. 1 includes a cardboard carrier 1, a cardboard cover 2, and a rotatable insert 3 fabricated from a transparent material. The rotatable insert 3 has blisters 4 whose shapes conform to that of the button cells, for example, six cells, to be accommodated. An associated button cell 5 having a label 6 that is capable of preventing air from entering the cell prior to its being placed in service is also depicted in FIG. 1.

The cardboard cover 2 has a central opening 7 to accommodate the rotatable insert 3. The cardboard carrier 1 has an opening 8 that maybe seen in FIG. 5. As indicated in FIGS.

2–4, which depict assembly procedures, the rotatable insert 3 may be rotated between the cardboard cover 2 and cardboard carrier 1. These latter two components are cemented or sealed together such that none of the button cells 5 may be removed from the rotatable insert 3 without destroying the packaging. A protrusion formed on the center of the rotatable insert 3 that forms the bearing about which it may be rotated engages the opening 8 in the cardboard carrier 1.

Figure 5:
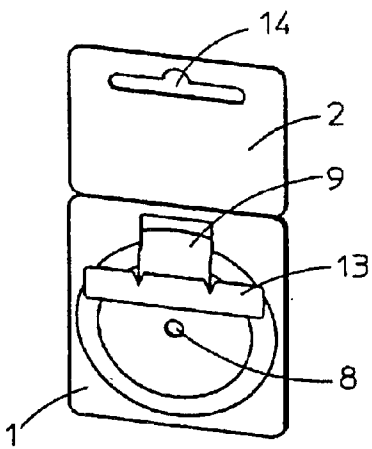
FIG. 5 depicts a perspective rear view of that packaging according to the invention.

FIG. 5 illustrates how a tab 9 that may be flipped out is provided on the cardboard carrier 1. Individual cells may be withdrawn from the packaging only by opening this tab 9, which may be inserted into a slot 10 in the cardboard cover 2 that hold the tab in the closed position when it is reinserted into the slot to re-secure it. A label 13 that is destroyed the first time the tab 9 is used, or the first time a button cell 5 is withdrawn from the packaging and, thus, if unbroken, provides a guaranty that the packaging has not been tampered with, is positioned over the tab 9.

It will be particularly beneficial to the handling of the device according to the invention if the opening 7 in the cardboard cover 2 has circumferential protrusions 12 that protrude into the opening 7. The spacing between paired adjacent protrusions roughly corresponds to the width of the outer end of a cell compartment 4 in the rotatable insert 3. Several, for example, six, such pairs of protrusions are arranged around the circumference of the opening 7. These protrusions define specific positions at which cells may be withdrawn from the packaging when the rotatable insert 3 is rotated, as may also be recognized from a visual inspection of the protrusions 12, as viewed from the front side of the packaging.

This new type of sale packaging allows simple, and invariably proper, withdrawal of button cells without use of force. Individual button cells do not fall out of the packaging or will be withdrawn therefrom without leaving traces thereof. The rotatable insert may be readily brought into the correct positions for withdrawing button cells. The ratcheting protrusions provided for that purpose are readily recognizable from the front side of the packaging. The security label on the reverse side of the packaging will indicate whether the packaging has been tampered with, since whether the dispensing tab has been previously opened will be readily recognizable.

What is claimed is:

1. A packaging for galvanic cells comprising:

a carrier;

a rotatable insert arranged on the carrier, wherein the rotatable insert has blisters to accommodate a plurality of the galvanic cells, several cell compartments for the cells, and a cell compartment is provided for each cell, and the carrier has a securable tab that allows withdrawal of one of the cells from the insert and an opening to withdraw one of the cells from the insert; and a cover, arranged such that the insert is arranged between the carrier and the cover, the carrier and the cover being sealed together such that the insert is free to rotate, wherein the cover has an opening to accommodate the insert, and the carrier has several pairs of protrusions arranged around the circumference of the opening, the protrusions protruding into the opening, and wherein a distance between two adjacent ones of the protrusions substantially corresponds to the width of an outer end of one of the cell compartments in the insert.

2. The packaging according to claim 1, wherein the galvanic cells are zinc-air cells.

3. The packaging according to claim 2, further comprising a label applied to the zinc-air cell to prevent air from entering the cell prior to being placed in service.

4. The packaging according to claim 1, wherein the packaging is sales or storage packaging.

5. The packaging according to claim 1, wherein the tab may be inserted into a slot provided in the cover.

6. The packaging according to claim 1, wherein the carrier or the cover are substantially planar.

7. The packaging according to claim 6, wherein the carrier or the cover consist of cardboard.

8. The packaging according to claim 1, further comprising a security seal applied to the tab, the security seal being arranged such that it will be destroyed the first time the tab is used or one of the cells is withdrawn from the packaging.

9. The packaging according to claim 8, wherein the security seal is a self-adhesive label.

10. A packaging for galvanic cells comprising a rotatable insert arranged on a carrier, made from transparent material, wherein the rotatable insert has blisters to accommodate several cells and the carrier has an opening to withdraw individual cells from the rotatable insert, wherein the rotatable insert is arranged between the carrier and a cover that are sealed together such that the insert is free to rotate, and wherein the cover has an opening to accommodate the rotatable insert and the carrier has a securable tab that permits withdrawal of individual cells from the rotatable insert, and the cover has several pairs of protrusions arranged around the circumference of the opening that protrude into the opening, wherein spacing between paired adjacent protrusions substantially corresponds to the width of the outer end of the blisters to accommodate cells in the rotatable insert.

11. The packaging according to claim 10, wherein the galvanic cells are zinc-air cells.

12. The packaging according to claim 11, further comprising a label applied to the zinc-air cells to prevent air entering the cell prior to being placed in service.

13. The packaging according to claim 10, which is a sale or storage packaging.

14. The packaging according to claim 10, wherein the tab may be inserted into a slot to resecure the carrier, where the slot is provided in the cover.

15. The according to claim 10, wherein at least one of the carrier and cover is substantially planar.

16. The packaging according to claim 15, wherein at least one of the carrier and cover is cardboard.

17. The packaging according to claim 10, further comprising a security seal in the form of a label that will be destroyed the first time the tab is used or a cell is withdrawn from the packaging applied to the tab.

* * * * *